US009956557B2

(12) United States Patent
Jiao et al.

(10) Patent No.: US 9,956,557 B2
(45) **Date of Patent: *May 1, 2018**

(54) RECONFIGURABLE MICROFLUIDIC SYSTEMS: MICROWELL PLATE INTERFACE

(71) Applicant: HJ Science & Technology, Inc., Berkeley, CA (US)

(72) Inventors: Hong Jiao, Santa Clara, CA (US); Erik C Jensen, Berkeley, CA (US); Homayun Mehrabani, Emeryville, CA (US); Liran Yosef Haller, Berkeley, CA (US)

(73) Assignee: HJ Science & Technology, Inc., Berkeley, CA (US)

( * ) Notice: Subject to any disclaimer, the term of this patent is extended or adjusted under 35 U.S.C. 154(b) by 14 days.

This patent is subject to a terminal disclaimer.

(21) Appl. No.: 14/808,933

(22) Filed: Jul. 24, 2015

(65) Prior Publication Data

US 2017/0021352 A1 Jan. 26, 2017

(51) Int. Cl.
*B01L 3/00* (2006.01)
*B01L 3/02* (2006.01)

(52) U.S. Cl.
CPC ..... *B01L 3/50273* (2013.01); *B01L 3/502746* (2013.01); *B01L 3/0293* (2013.01); *B01L 3/502738* (2013.01); *B01L 2200/027* (2013.01); *B01L 2300/0864* (2013.01); *B01L 2300/0867* (2013.01); *B01L 2300/0877* (2013.01); *B01L 2300/14* (2013.01); *B01L 2300/165* (2013.01); *B01L 2400/049* (2013.01); *B01L 2400/0487* (2013.01); *B01L 2400/088* (2013.01)

(58) Field of Classification Search
CPC ..... B01L 2200/027; B01L 2300/0877; B01L 2300/165; B01L 3/502715; B01L 3/502746; B01L 2400/088
See application file for complete search history.

(56) References Cited

U.S. PATENT DOCUMENTS 3,993,062 A 11/1976 Jess
5,726,404 A 3/1998 Brody
6,086,825 A 7/2000 Sundberg et al.
(Continued)

FOREIGN PATENT DOCUMENTS

WO WO 0078456 A1 * 12/2000 ..... B01J 4/00

OTHER PUBLICATIONS

Oh, K. W.; Ahn, C. H., "A review of microvalves." Journal of Micromechanics and Microengineering, 2006, 16, R13.
(Continued)

*Primary Examiner* — Lyle Alexander
*Assistant Examiner* — Bryan Kilpatrick
(74) *Attorney, Agent, or Firm* — Weaver Austin Villeneuve & Sampson LLP

(57) ABSTRACT

Reconfigurable microfluidic systems are based on networks of microfluidic cavities connected by hydrophobic microfluidic channels. Each cavity is classified as either a reservoir or a node, and includes a pressure port via which gas pressure may be applied. Sequences of gas pressures, applied to reservoirs and nodes according to a fluid transfer rule, enable fluid to be moved from any reservoir to any other reservoir in a system. Such systems are suitable for automated microwell plate interfaces.

24 Claims, 21 Drawing Sheets

(56) References Cited

U.S. PATENT DOCUMENTS

| | | | |
|---|---|---|---|
| 6,568,910 | B1 | 5/2003 | Parce |
| 6,811,668 | B1 | 11/2004 | Berndt et al. |
| 6,989,130 | B2 | 1/2006 | Deshmukh |
| 7,445,926 | B2 | 11/2008 | Mathies et al. |
| 7,601,270 | B1 | 10/2009 | Unger et al. |
| 7,695,603 | B2 | 4/2010 | Paul et al. |
| 8,075,854 | B2 | 12/2011 | Yang et al. |
| 8,122,901 | B2 | 2/2012 | Zeng et al. |
| 9,733,239 | B2 | 8/2017 | Jiao et al. |
| 2002/0003001 | A1 | 1/2002 | Weigl et al. |
| 2002/0043463 | A1 | 4/2002 | Shenderov |
| 2002/0150512 | A1 | 10/2002 | Kellogg et al. |
| 2004/0055891 | A1 | 3/2004 | Pamula et al. |
| 2004/0109793 | A1* | 6/2004 | McNeely ..... B01F 5/0642 422/400 |
| 2004/0202579 | A1 | 10/2004 | Larsson et al. |
| 2004/0228771 | A1 | 11/2004 | Zhou |
| 2005/0130292 | A1 | 6/2005 | Ahn et al. |
| 2005/0217742 | A1 | 10/2005 | Bohm |
| 2005/0255003 | A1 | 11/2005 | Summersgill |
| 2007/0075010 | A1 | 4/2007 | Gilbert et al. |
| 2007/0113908 | A1 | 5/2007 | Lee et al. |
| 2007/0166199 | A1 | 7/2007 | Zhou |
| 2008/0281090 | A1 | 11/2008 | Lee et al. |
| 2009/0165876 | A1 | 7/2009 | Atkin et al. |
| 2011/0120562 | A1 | 5/2011 | Tan |
| 2011/0301535 | A1 | 12/2011 | Takayama et al. |
| 2014/0287966 | A1 | 9/2014 | Gray et al. |
| 2015/0132742 | A1* | 5/2015 | Thuo ..... B01L 3/502707 435/5 |
| 2017/0021351 | A1 | 1/2017 | Jiao et al. |
| 2017/0021353 | A1 | 1/2017 | Jiao et al. |

OTHER PUBLICATIONS

Thorsen T, Maerkl SJ, Quake SR, "Microfluidic large-scale integration." Science, Oct. 18, 2002; 298 (5593) :580-4.

Unger MA, Chou HP, Thorsen T, Scherer A, Quake SR, "Monolithic microfabricated valves and pumps by multilayer soft lithography." Science, Apr. 7, 2000; 288 (5463):113-6.

WH Grover, AM Skelley, CN Liu, ET Lagally, RA Mathies, "Monolithic membrane valves and diaphragm pumps for practical large-scale integration into glass microfluidic devices." Sensors and Actuators B: Chemical 89 (3), 315-323.

Srinivasan, V; Pamula, V. K.; and Fair, R. B.; "Droplet-based microfluidic lab-on-a-chip for glucose detection." Anal. Chim. Acta., 2004, 507, 145-150.

Miller, E. M.; and Wheeler, A. R.; "A digital microfluidic approach to homogeneous enzyme assays," Anal Chem, 2008, 80, 1614-1619.

Teh, S. Y.; Lin, R.; Hung, L. H.; and Lee, A. P.; "Droplet microfluidics," Lab Chip, 2008, 8, 198-220.

DJ Harrison, A Manz, Z Fan, H Luedi, HM Widmer, "Capillary electrophoresis and sample injection systems integrated on a planar glass chip." Analytical chemistry 64 (17), 1926-1932.

Yanying Feng, Zhaoying Zhou, Xiongying Ye, Jijun Xiong, "Passive valves based on hydrophobic microfluidics," Sensors and Actuators A: Physical, vol. 108, Issues 1-3, Nov. 15, 2003, pp. 138-143.

Kim SJ, Paczesny S, Takayama S, Kurabayashi K. "Preprogrammed capillarity to passively control system-level sequential and parallel microfluidic flows." Lab Chip. Jun. 7, 2013;13(11):2091-8.

K. Ellinas, A. Tserepi, E. Gogolides, "Superhydrophobic, passive microvalves with controllable opening threshold: Exploiting plasma nanotextured microfluidics for a programmable flow switchboard", Microfluidics & Nanofluidics, DOI 10.1007/s10404-014-1335-9.

McNeely, M. R.; Spute, M. K.; Tusneem, N. A.; Oliphant, A. R. "Hydrophobic microfluidics." in Proc. SPIE, Ahn, C. H.; Frazier, A. B.; Eds.; 1999, 3877; pp. 210-220.

McNeely, M. R., Sputea, M. K., Tusneem, N. A., & Oliphant, A. R. "Sample Processing with Hydrophobic Microfluidics." JALA, 1999, 4 (4), 30-33.

Hansang Cho, Ho-Young Kim, Ji Yoon Kang, Tae Song Kim, "How the capillary burst microvalve works," Journal of Colloid and Interface Science, vol. 306, Issue 2, Feb. 15, 2007, pp. 379-385.

Daniel Irimia, "Capillary Force Valves" in Encyclopedia of Micro- and Nanofluidics edited by Li, Dongqing. 2006.

Man P F, Mastrangelo C H, Burns M A and Burke D T, "Microfabricated capillary-driven stop valve and sample injector" MEMS '98, pp. 45-50.

Yokoyama Y, Takeda M, Umemoto T and Ogushi T, "Thermal micro pumps for a loop-type micro channel," Sensors Actuators A, 2004, 111 123-8.

Melin J, Roxhed N, Gimenez G, Griss P, van der Wijngaart W and Stemme G, "A liquid-triggered liquid microvalve for on-chip flow control," Sensors Actuators B, 2004, 100 463-8.

Duffy D C, Gillis H L, Lin J, Sheppard N F and Kellogg G J, "Microfabricated centrifugal microfluidic systems: characterization and multiple enzymatic assays", Anal. Chem., 1999, 71 4669-78.

Johnson R D, Badr I H A, Barrett G, Lai S, Lu Y, Madou M J and Bachas L G, "Development of a fully integrated analysis system for ions based on ion-selective optodes and centrifugal microfluidics", Anal. Chem., 2001, 73 3940-6.

Puckett L G, Dikici E, Lai S, Madou M, Bachas L G and Daunert S, "Investigation into the applicability of the centrifugal microfluidics platform for the development of protein-ligand binding assays incorporating enhanced green fluorescent protein as a fluorescent reporter", Anal. Chem., 2004, 76 7263-8.

Leu T-S and Chang P-Y, "Pressure barrier of capillary stop valves in micro sample separators", Sensors Actuators A, 2004, 115 508-15.

Ahn C H, Choi J-W, Beaucage G, Nevin J H, Lee J-B, Puntambekar A and Lee J Y, "Disposable smart lab on a chip for point-of-care clinical diagnostics", Proc. IEEE, 2004, 92 154-73.

Yamada M and Seki M, "Nanoliter-sized liquid dispenser array for multiple biochemical analysis in microfluidic devices," Anal. Chem., 2004, 76 895-9.

Andersson H, van der Wijngaart W, Griss P, Niklaus F and Stemme G, "Hydrophobic valves of plasma deposited octafluorocyclobutane in DRIE channels," Sensors Actuators B, 2001, 75 136-41.

Andersson H, van der Wijngaart W and Stemme G, "Micromachined filter-chamber array with passive valves for biochemical assays on beads," Electrophoresis, 2001, 22 249-57.

Mosadegh B, Kuo CH, Tung YC, Torisawa YS, Bersano-Begey T, Tavana H, Takayama S., "Integrated Elastomeric Components for Autonomous Regulation of Sequential and Oscillatory Flow Switching in Microfluidic Devices," Nature Physics, Jun. 1, 2010;6(6):433-437.

James Friend, Leslie Y. Yeo, "Microscale acoustofluidics: Microfluidics driven via acoustics and ultrasonics," Rev. Mod. Phys., vol. 83, No. 2, Apr.-Jun. 2011.

Trung-Dung; Nguyen, Nam-Trung, "Surface Acoustic Wave Driven Microfluidics—A Review", Micro and Nanosystems, vol. 2(3), pp. 217-225, (2010).

U.S. Office Action dated Mar. 20, 2017 in U.S. Appl. No. 14/808,929.

U.S. Office Action dated Mar. 23, 2017 in U.S. Appl. No. 14/808,939.

U.S. Notice of Allowance dated Jun. 29, 2017 in U.S. Appl. No. 14/808,939.

U.S. Final Office Action dated Sep. 12, 2017 in U.S. Appl. No. 14/808,929.

International Search Report and Written Opinion dated Oct. 14, 2016 in Application No. PCT/US2016/39619.

International Search Report and Written Opinion dated Nov. 10, 2016 in Application No. PCT/US2016/040071.

* cited by examiner

+ Zero dilution steps
o One dilution step
x Two dilution steps (serial dilution)

RECONFIGURABLE MICROFLUIDIC SYSTEMS: MICROWELL PLATE INTERFACE

RELATED APPLICATIONS

This application is related to "Reconfigurable microfluidic systems: Homogeneous assays", U.S. Ser. No. 14/808,929, filed on Jul. 24, 2015 and "Reconfigurable microfluidic systems: Scalable, multiplexed immunoassays", U.S. Ser. No. 14/808,939, filed on Jul. 24, 2015.

TECHNICAL FIELD

The disclosure is generally related to microfluidic systems.

BACKGROUND

Microfluidic systems manipulate microliter and smaller scale volumes of fluids. Ink-jet printing and biochemical assays are two prominent applications of microfluidics among many others. The ability to move, control and mix tiny quantities of liquids is valuable in biochemistry since it permits more experiments to be done with a given amount of starting material. The increased surface-to-volume ratio associated with microfluidic channels as compared to traditional microwell plates also speeds up surface reactions upon which some kinds of assays are based.

Despite the profound advances in microfluidics achieved over the last 30 years, there is room for improvement. It is still a challenge, for example to make microfluidic valves that open and shut as reliably as conventional size valves. New approaches to interfaces between microfluidic devices and microwell plates are needed. Finally, microfluidic assays need to be made scalable so that hundreds or thousands of assays can be performed in parallel on one chip.

DETAILED DESCRIPTION

Reconfigurable microfluidic systems are based on networks of microfluidic cavities connected by hydrophobic microfluidic channels. Each cavity is classified as either a reservoir or a node, and includes a pressure port via which gas pressure may be applied. Sequences of gas pressures, applied to reservoirs and nodes according to a fluid transfer rule, enable fluid to be moved from any reservoir to any other reservoir in a system.

Reconfigurable microfluidic systems may be designed from these basic components—reservoirs, nodes and channels—to perform many different microfluidic tasks including homogenous and inhomogeneous assays and microwell plate interfacing. The systems are scalable to any number of fluid inputs and outputs, and they can manipulate very small fluid volumes necessary for multiplexing samples with analytes to perform multiple simultaneous assays.

A microfluidic cavity is an internal volume for accumulating fluid in a microfluidic device. A reservoir is a microfluidic cavity that is connected to only one microfluidic channel. A node is a microfluidic cavity that is connected to more than one microfluidic channel. Finally, a channel is a microfluidic passageway between nodes or reservoirs. Each channel in a reconfigurable microfluidic system connects at most two cavities. Said another way, there are no channel intersections.

Nodes are designed to present lower resistance to fluid flow than are channels. The fluid flow resistance of a cavity or channel is inversely proportional to the square of its cross sectional area. Therefore the difference in flow resistance between a channel and a reservoir, or between a channel and a node, may be engineered via different cross sectional areas.

Reservoirs store fluids; e.g. samples or reagents. Nodes, on the other hand, do not store fluid, except temporarily during a sequence of fluid transfer steps. Provisions for automated loading fluid into, or unloading fluid from, a reservoir may be provided, with a small plastic tube extending from a reservoir to a glass bottle being a simple example.

Reconfigurable microfluidic systems may be implemented in a variety of ways as long as: reservoirs, nodes, channels and pressure ports are provided; resistance to fluid flow is greater in the channels than in the nodes; and the channels are hydrophobic to prevent fluid flow when pressures at the two ends of a channel are equal or nearly so. A typical implementation includes a substrate layer, a hydrophobic fluid layer, and a pneumatic layer.

Figure 1:
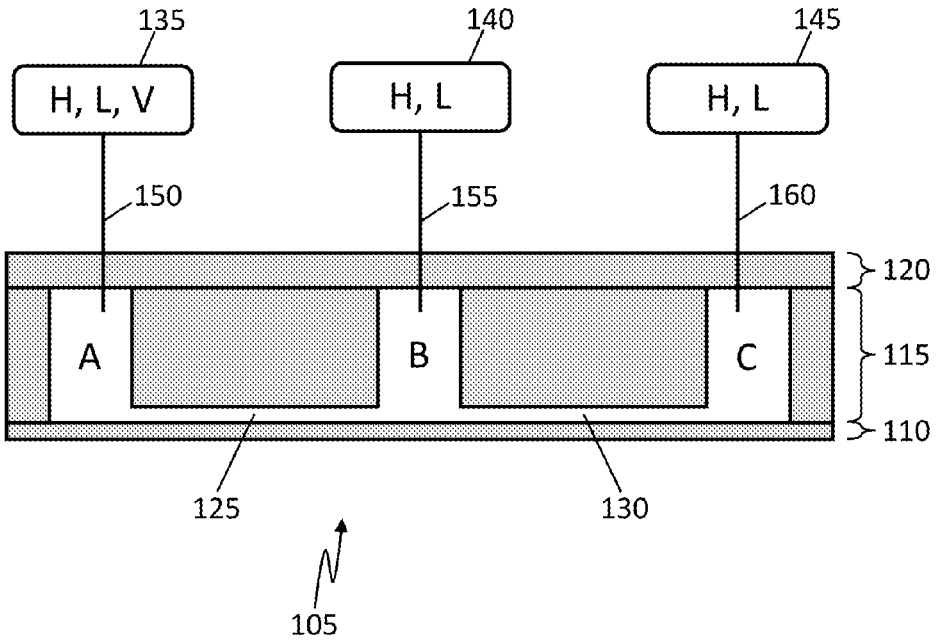
FIG. 1 is diagram of a reconfigurable microfluidic device, seen in cross section.

FIG. 1 is diagram of a reconfigurable microfluidic device, seen in cross section. In FIG. 1, microfluidic device 105 includes a substrate layer 110, a hydrophobic fluidic layer 115, and a pneumatic layer 120. Cavities in the hydrophobic fluidic layer are labeled 'A', 'B' and 'C'. Cavities A and B are connected by channel 125 while cavities B and C are connected by channel 130. Cavities A and C are classified as reservoirs because they are connected to only one channel each. Cavity B is classified as a node because it is connected to more than one channel: B is connected to both channel 125 and channel 130.

Pressure sources 135, 140 and 145 are connected to reservoir A, node B and reservoir C, respectively, via gas tubes 150, 155 and 160 respectively. Each of the three pressure sources is capable of providing at least two different pressures: a high pressure and a low pressure. Labels 'H' and 'L' in the figure refer to the capability of a pressure source to provide a high or low pressure. Pressure source 135 is also capable of providing a pressure that is less than atmospheric pressure; i.e. a partial vacuum. Label 'V' in the figure refers to this capability. As an example, high pressure may be about 2 kPa, low pressure may be about 0 kPa, and partial vacuum pressure may be about ~6 kPa, where all pressures are gauge pressures.

Several different ways of making a structure like microfluidic device 105 are possible. As a first example, substrate 110 may be made of glass, polydimethylsiloxane (PDMS), polyethylene terephthalate (PET), or plastic. Hydrophobic fluidic layer 115 may be made from PDMS. A mold for casting PDMS to define hydrophobic microfluidic channels may be produced with a programmable cutter for vinyl decals or defined photolithographically in an epoxy-based negative photoresist such as SU-8. After patterned PDMS is cured and removed from a mold, it may be bonded to a flat substrate. Pneumatic layer 120 may also be made from PDMS. Gas tubes may be made from polyetheretherketone (PEEK) tubing which forms convenient seals when inserted in appropriately sized holes in PDMS. Hydrophobic materials that are suitable alternatives to PDMS include fluorinated ethylene propylene (FEP) and polytetrafluoroethylene (PTFE).

In example devices, the cross-sectional dimensions of channels 125 and 130 were about 100 μm by about 300 μm. The sizes of reservoirs A and C, and of node B were between about 2 mm and about 4 mm in diameter. The distance between reservoir A and node B was between about 5 mm and about 10 mm; the distance between node B and reservoir C was about the same. The cross-sectional areas of the cavities in typical devices are approximately 100 to 400 times greater than the cross-sectional areas of the channels. Therefore the flow resistance of the channels is about 10,000 to 160,000 times greater than the flow resistance of the cavities. Alternative designs for channels and cavities lead to the flow resistance of channels being about 100 times greater or about 1,000 times greater than the flow resistance of cavities.

A second way to make a structure like microfluidic device 105 is hot embossing a hydrophobic thermoplastic polymer such as cyclic olefin copolymer (COC) followed by solvent-assisted lamination to form enclosed, hydrophobic channels. A third way to make a structure like microfluidic device 105 is injection molding a hydrophobic polymer such as COC. Finally, hydrophilic microfluidic channels, formed in polycarbonate for example, may be made hydrophobic via chemical surface treatment. There are, no doubt, other ways to make a structure containing cavities connected by hydrophobic microfluidic channels.

Figure 2:
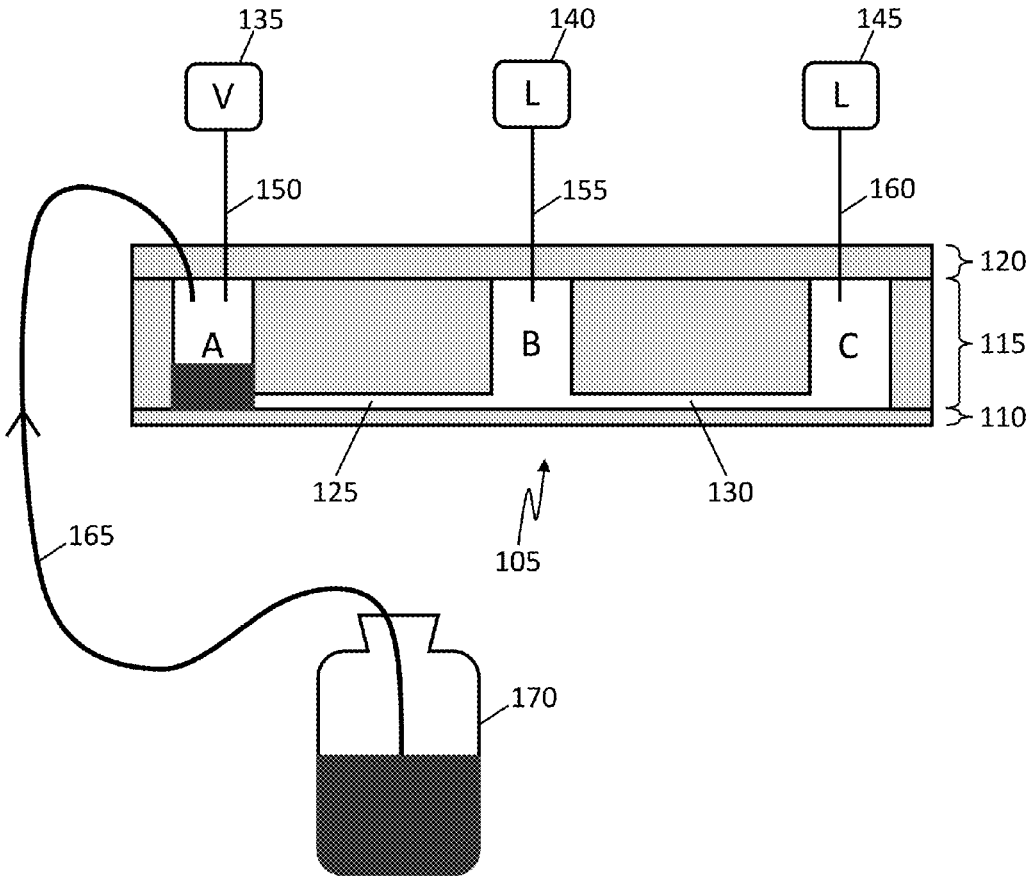
FIG. 2 illustrates loading the device of FIG. 1 from an external fluid source.

FIG. 2 illustrates loading the device of FIG. 1 from an external fluid source. In FIG. 2, reference numbers 105-160 refer to the same items as in FIG. 1. In FIG. 2, however, pressure sources 135, 140 and 145 supply partial vacuum, low pressure and low pressure, respectively. Supply tube 165 connects reservoir A to an external fluid source 170 that is at atmospheric pressure. When a partial vacuum is applied to reservoir A by pressure source 135 via gas tube 150, fluid is withdrawn from fluid source 170 and accumulated in reservoir A. Fluid does not flow from reservoir A to node B in this situation because the gas pressure applied to node B is higher than the gas pressure applied to reservoir A.

Figure 3:
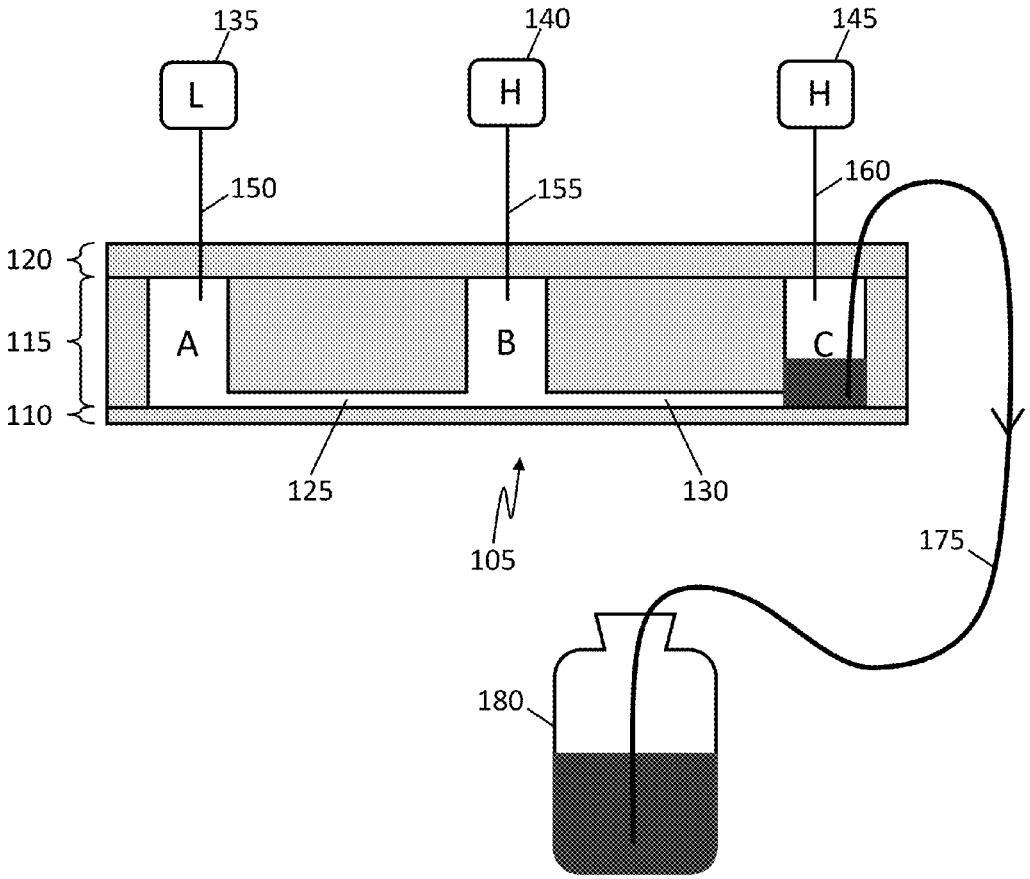
FIG. 3 illustrates unloading the device of FIG. 1 to an external fluid store.

FIG. 3 illustrates unloading the device of FIG. 1 to an external fluid store. In FIG. 3, reference numbers 105-160 refer to the same items as in FIG. 1. In FIG. 3, however, pressure sources 135, 140 and 145 supply low pressure, high pressure and high pressure, respectively. Drain tube 175 connects reservoir C to an external fluid store 180. The fluid store is at atmospheric pressure. When high pressure is applied to reservoir C by pressure source 145 via gas tube 160, fluid is expelled from reservoir C and accumulated in fluid store 180. Fluid does not flow from reservoir C to node B in this situation because the gas pressure applied to node B is the same as the gas pressure applied to reservoir C.

In reconfigurable microfluidic systems, fluid flow through microfluidic channels is controlled by gas pressure differences applied to reservoirs and nodes. Fluid flow through a hydrophobic channel exhibits a pronounced threshold effect. At first, no fluid flows as the pressure difference from one end of the channel to the other is increased. However, once a threshold pressure difference is reached, fluid flow rate through the channel increases in proportion to applied pressure difference. The hydrophobicity of channels sets the threshold pressure difference, and the difference between "high" and "low" pressures used in a system is designed to be greater than the hydrophobic threshold pressure. Thus, when the pressure is "high" at one end of a channel and "low" at the other end, fluid flows rapidly in the channel.

The hydrophobic threshold pressure of hydrophobic channels keeps fluid in nodes and reservoirs from leaking into the channels when no pressure differences are applied. The threshold pressure is designed to be great enough to prevent fluid flow that might be driven by the hydrodynamic pressure caused by the weight of fluid in a reservoir or node, or by residual pressure differences that might exist when applied pressures are switched between "high" and "low". Thus a "hydrophobic channel" is defined as one that exhibits a pressure threshold that prevents fluid from leaking into the channel when the pressure difference between the two ends of the channel is less than a design pressure. In an example reconfigurable microfluidic system, channels were designed to have about 1 kPa hydrophobic threshold pressure.

Fluid transfer between reservoirs and nodes is accomplished by switching pressures applied to each reservoir and node in a system according to a specific pattern. The following terminology aids discussion of a fluid transfer rule for reconfigurable microfluidic systems. The origin is a reservoir or node from which fluid is to be transferred. The destination is the reservoir or node to which fluid is to be transferred. Two gas pressures are needed: high pressure and low pressure.

A fluid transfer rule for reconfigurable microfluidic systems may be summarized in the following steps:

Step 0: Apply low pressure to all cavities.

Step 1: Apply high pressure to the origin and any cavity connected to the origin by a channel, other than the destination. Apply low pressure to the destination and any cavity connected to the destination, other than the origin.

Step 2 (optional): Switch origin back to low pressure. The purpose of this optional step is to ensure an air gap (i.e. section without fluid) exists in all channels after Step 1. This optional step is useful when transferring less than all of the fluid that is in the origin cavity at Step 0.

Step 3: Return to Step 0 to prepare for the next fluid transfer operation.

As explained below, the fluid transfer rule may be executed by a pressure sequencer that provides the necessary sequence of pressures to accomplish any desired fluid transfer operation. Two examples show how the fluid transfer rule is used to perform common fluid transfer experiments. The first example demonstrates flow rate control when fluid is transferred from one cavity to another; the second example demonstrates automated dilution of a fluid sample.

Example 1: Flow Rate Control

Figure 4A:
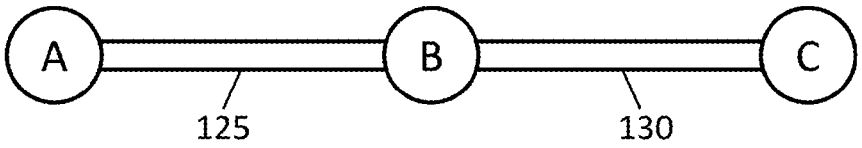
FIGS. 4A, 4B and 4C are diagrams illustrating operation of the device of FIG. 1, seen in plan view.
Figure 4B:
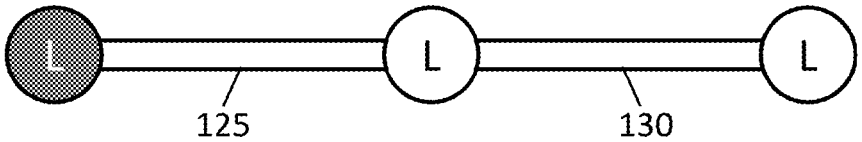
Figure 4C:
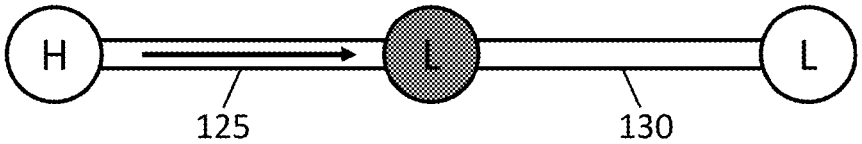

FIGS. 4A, 4B and 4C are diagrams illustrating operation of the device of FIG. 1, seen in plan view. In particular, FIG. 4A shows a plan view of reservoir A, node B and reservoir C, connected by channels 125 and 130. In FIGS. 4B and 4C, labels 'A', 'B' and 'C' are replaced by 'L', 'L' and 'L' (FIG. 4B) and 'H', 'L' and 'L' (FIG. 4C). FIG. 4A serves as a key for FIGS. 4B and 4C. 'H' and 'L' in FIGS. 4B and 4C show which cavities have high and low pressure applied to them. Shading in FIGS. 4B and 4C, and the arrow in FIG. 4C, shows that fluid moves from reservoir A to node B.

The fluid transfer rule explains how the fluid transfer depicted in FIGS. 4B and 4C is accomplished. Step 0 of the rule specifies that low pressure is applied to all cavities. FIG. 4B shows low pressure, 'L', applied to reservoir A, node B and reservoir C. Shading of reservoir A in FIG. 4B means that the reservoir has fluid in it, while node B and reservoir C are empty. Reservoir A is the origin.

Step 1 of the fluid transfer rule specifies that high pressure is applied to the origin and any cavity connected to the origin by a channel, other than the destination. Further, low pressure is applied to the destination and any cavity connected to the destination, other than the origin. This is the situation depicted in FIG. 4C. The result is fluid transfer from the origin to the destination.

All other conditions being equal, the volume of fluid transferred from the origin to the destination depends on the amount of time that pressure is applied during Step 1 of the fluid transfer rule. An experiment was conducted to demonstrate flow rate control in an apparatus similar to that shown in FIGS. 1-4.

Figure 5:
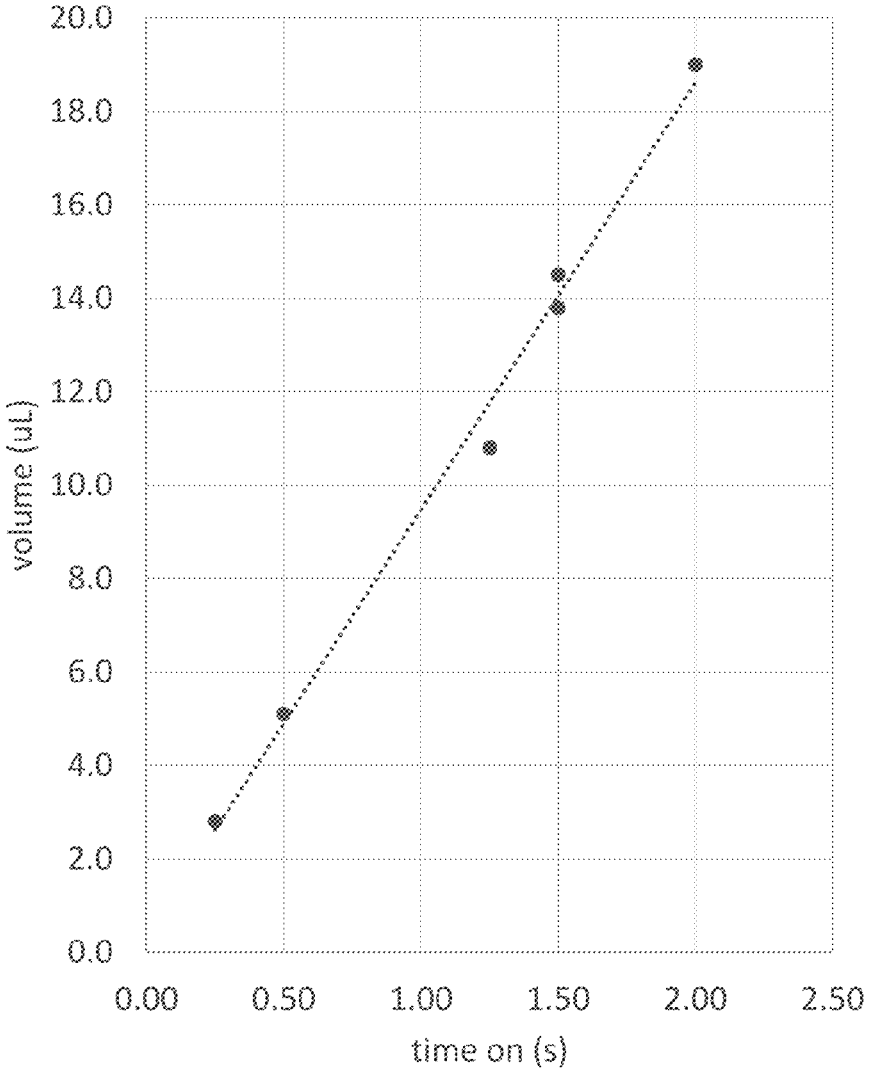
FIG. 5 is a graph of fluid volume transferred between a reservoir and a node of a device similar that of FIG. 1.

FIG. 5 is a graph of fluid volume transferred between a reservoir and a node of a device similar that of FIG. 1. The graph shows volume of fluid transferred in microliters (4) versus time (in seconds) that pressure was applied during Step 1 of the fluid transfer rule. The six black dots on the graph represent experimental data while the dashed line is a linear fit to the data. The observed flow rate is approximately 10 μL per second.

During the experiment, there was no leakage of fluid to reservoir C, even though node B and reservoir C were held at the same low pressure compared to reservoir A. Leakage to reservoir C was prevented by the high flow resistance of channel 130 compared to that of node B.

Example 2: Automated Dilution

Figure 6:
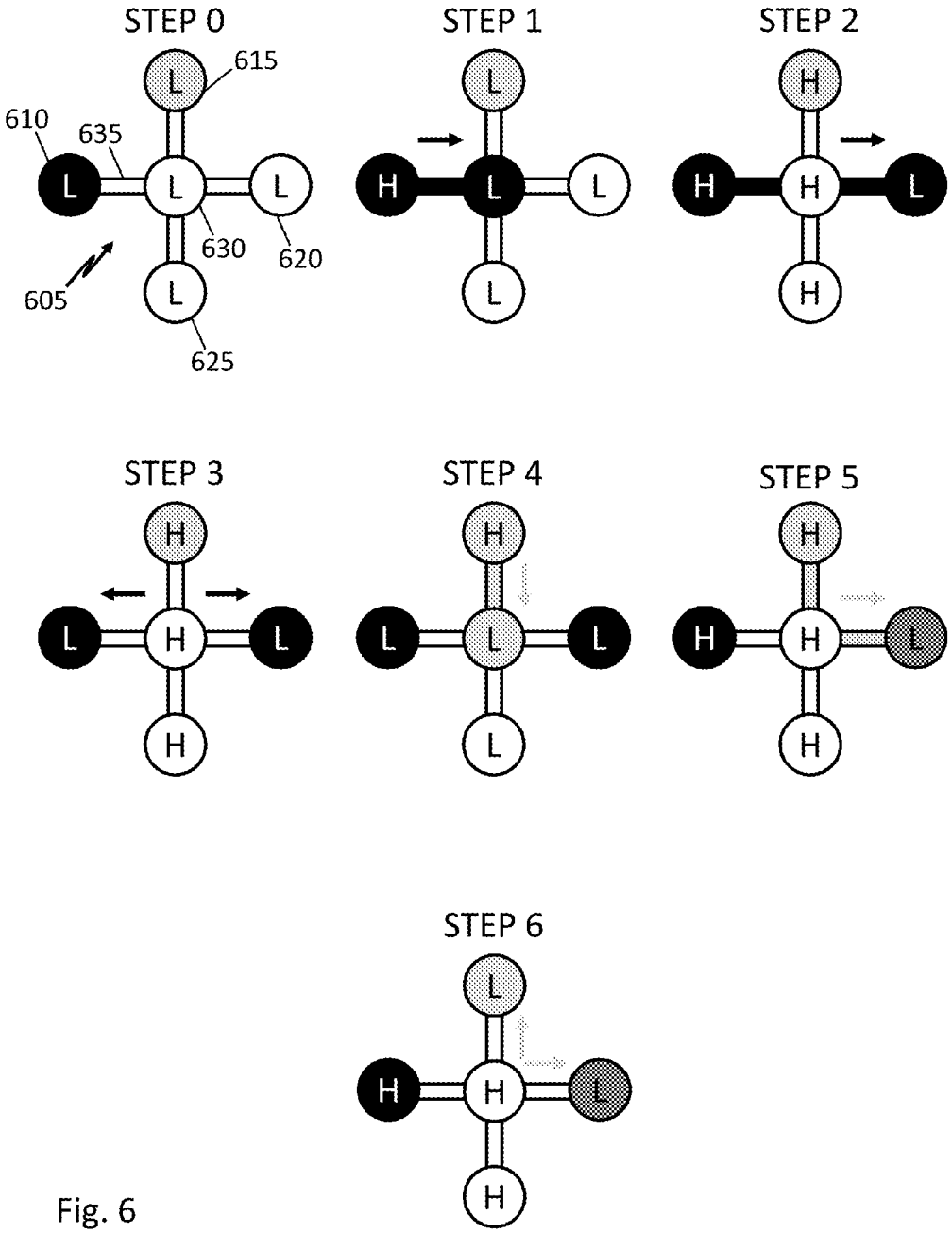
FIG. 6 is a diagram illustrating operation of a reconfigurable microfluidic device, seen in plan view.

FIG. 6 is a diagram illustrating operation of a reconfigurable microfluidic device, seen in plan view. In FIG. 6, the same device 605 is shown seven times under headings 'STEP 0', 'STEP 1', . . . , 'STEP 6'. Device 605 is similar in construction to the device of FIGS. 1-4, however device 605 has four reservoirs (610, 615, 620, 625) and one node (630). To improve visual clarity, reference numerals are not repeated for the device when it is shown under headings 'STEP 1' through 'STEP 6'. Each reservoir is connected to node 630 via its own channel. For example, channel 635 connects reservoir 610 to node 630. The other channels do not have reference numerals. The reservoirs, the channels and the node are drawn in black, gray or white during various steps. Black and gray represent two different fluids, while white represents an absence of fluid.

As discussed above, the fluid transfer rule in its basic form alternates between two states. The first state is an initial, rest condition where all cavities are at low pressure. In the second state, fluid is transferred from an origin to a destination. These two states are referred to as 'Step 0' and 'Step 1' above.

FIG. 6 uses "step" terminology. However, 'STEP 0' through 'STEP 6' in FIG. 6 are not intended to match the steps of the fluid transfer rule. Instead 'STEP 0' through 'STEP 6' are steps in an overall program during which the steps of the fluid transfer rule are applied repeatedly.

The overall result of the program shown in FIG. 6 is that some fluid from reservoir 610 is moved to reservoir 620 and some fluid from reservoir 615 is also moved to reservoir 620. Thus, at the end of the program, in 'STEP 6', reservoir 620 contains a mixture of fluids from reservoirs 610 and 615. Equivalently, reservoir 620 contains a dilution of fluid from reservoir 610 by fluid from reservoir 615.

A sequence of pressures is applied to the reservoirs and node of device 605. Pressures are indicated by labels 'H' for high pressure and 'L' for low pressure in FIG. 6. STEP 0 shows the reservoirs and node all at low pressure. Reservoirs 620 and 625, and node 630 do not contain fluid. Reservoirs 610 and 615 contain different fluids indicated by black and gray shading.

In STEP 1, high pressure is applied to origin reservoir 610 and low pressure is applied to destination node 630 and to all cavities connected to the destination, other than the origin. Fluid flows from the origin to the destination. Although not illustrated, after STEP 1, system pressures are returned briefly to the initial condition, all cavities at low pressure as in STEP 0. A reset to all cavities at low pressure occurs before and after each illustrated STEP.

In STEP 2, node 630 is the origin and reservoir 620 is the destination. Therefore high pressure is applied to the origin and all cavities connected to it, other than the destination. Low pressure is applied to the destination. Fluid flows from the origin to the destination.

STEP 3 is an example of optional Step 2 of the fluid transfer rule. The purpose of this step is to clear the channels between node 630 and reservoirs 610 and 620. An air gap must exist in a channel in order for the channel to present a hydrophobic barrier to fluid flow. Without the operation shown in STEP 3, channel 635, and the channel connecting node 630 to reservoir 620, could be left with fluid in them that would defeat their hydrophobic barriers.

In STEP 3, reservoir 610 is switched briefly back to low pressure while all other pressures remain as in STEP 2. This causes any fluid left in channel 635 to be sent back to reservoir 610. There are alternative ways to accomplish this "channel clearing" function as discussed below. Channel clearing may be needed in cases where less than all of the fluid at the origin is moved to the destination in one cycle of the fluid transfer rule.

STEP 4, STEP 5 and STEP 6 are analogous to STEP 1, STEP 2 and STEP 3 except that fluid is moved from reservoir 615 to reservoir 620 instead of from reservoir 610 to 620. Since the amount of fluid moved from one cavity to another can be controlled by the time that pressures are applied, as demonstrated in Example 1, the ratio of fluid moved to reservoir 620 from reservoir 610 to fluid moved to reservoir 620 from reservoir 615 can be adjusted at the discretion of the experimenter. Thus automated dilution may be performed by selecting an appropriate sequence of pressures to be applied to the cavities of device 605.

Figure 7:
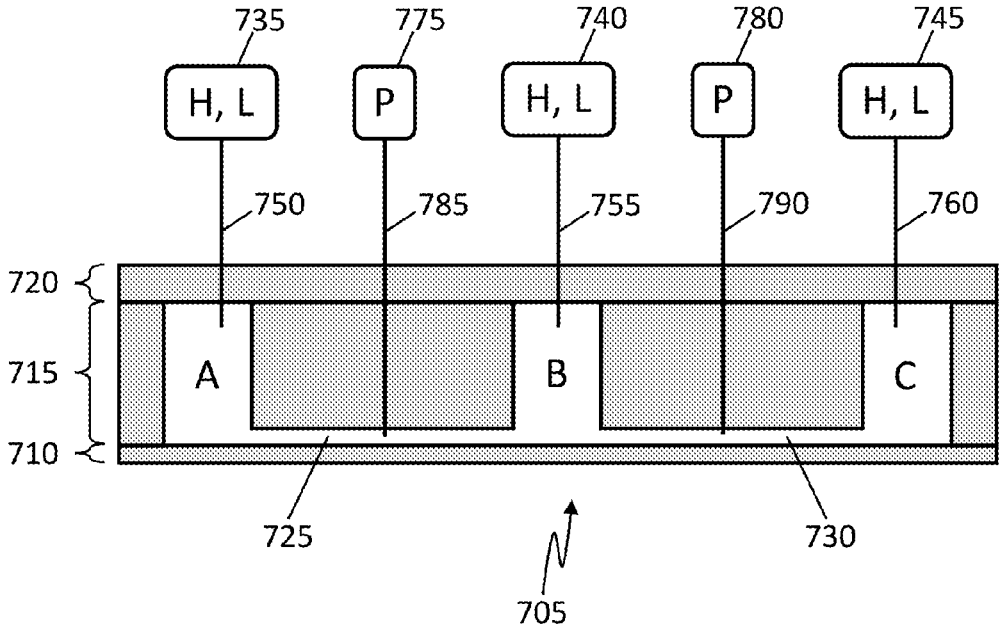
FIG. 7 is a diagram of a reconfigurable microfluidic device, seen in cross section, including ports for clearing microfluidic channels.

An alternate means for clearing out channels when only some of the fluid in an origin cavity is transferred away involves dedicated gas tubes connected to the channels. FIG. 7 is a diagram of a reconfigurable microfluidic device, seen in cross section, including ports for clearing microfluidic channels. The device of FIG. 7 is nearly the same as that of FIG. 1, except that gas tubes, pressure ports and gas pressure sources are provided to enable creation of air gaps in channels.

In FIG. 7, microfluidic device 705 includes a substrate layer 710, a hydrophobic fluidic layer 715, and a pneumatic layer 720. Cavities in the hydrophobic fluidic layer are labeled 'A', 'B' and 'C'. Reservoir A and node B are connected by channel 725 while node B and reservoir C are connected by channel 730.

Pressure sources 735, 740 and 745 are connected to reservoir A, node B and reservoir C, respectively, via gas tubes 750, 755 and 760 respectively. Each of the three pressure sources is capable of providing at least two different pressures: a high pressure and a low pressure.

Pressure sources 775 and 780 are connected to channels 725 and 730 respectively, via gas tubes 785 and 790 respectively. The gas tubes present a higher barrier to fluid flow than the channels. In normal operation of device 705 only gas, never fluid, flows in the gas tubes.

It is apparent that if device 605 of FIG. 6 were equipped with channel clearing gas tubes like gas tubes 785 and 790 of FIG. 7, then STEP 3 (optional Step 2 of the fluid transfer rule) could be replaced by a clearing STEP in which pressure is applied to channel clearing gas tubes while low pressure would be applied to all the cavities in the system.

Figure 8:
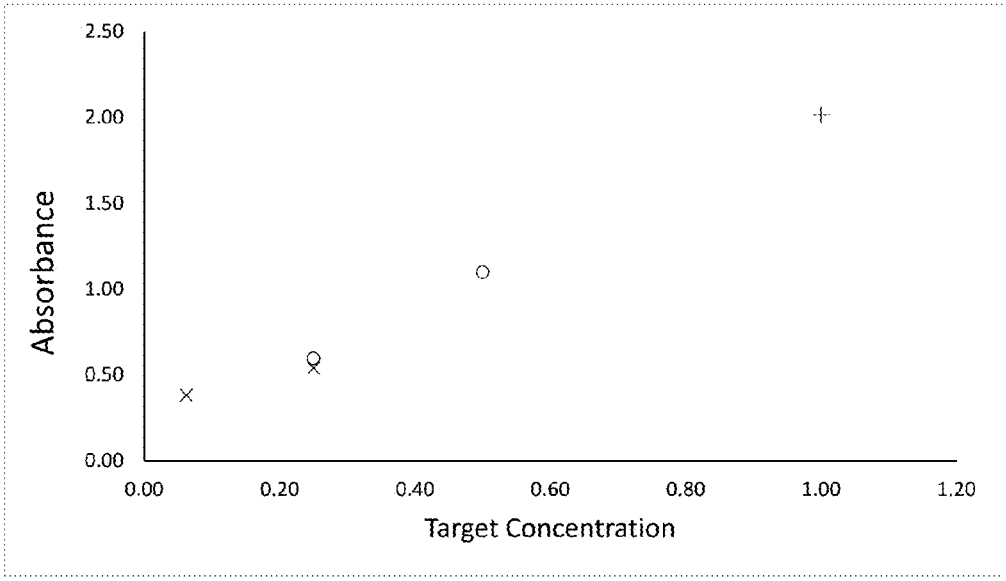
FIG. 8 is a graph of absorbance representing results of an automated dilution experiment.

An experiment was conducted to demonstrate automated dilution in an apparatus similar to that shown in FIG. 6. FIG. 8 is a graph of absorbance representing results of an automated dilution experiment. In the automated dilution experiment, concentration of an aqueous solution was inferred from optical absorbance measurements where higher absorbance corresponded to higher concentration of solute. (Optical absorbance varies linearly with concentration according to Beer's Law.) The graph in FIG. 8 therefore plots absorbance, representing measured concentration, versus target, or expected, concentration. Target concentration is an expected result if the amounts of fluid transferred into the destination reservoir from the origin solute and solvent reservoirs are as expected.

When no dilution is performed ("Zero dilution steps", "+" data point marker), absorbance 2.00 (in arbitrary units) corresponds to target concentration 1.00 (in arbitrary units). Target concentrations of 0.50 and 0.25 may be obtained in one dilution step; i.e. one time through STEPS 0 through 6 of FIG. 6. Data obtained in this way is labeled "One dilution step" and shown with "o" data point markers on the graph.

Finally data obtained after two dilution steps ("Two dilution steps (serial dilution)", "x" data point markers) is shown for target concentrations of 0.25 and 0.0625. In this case the procedure of FIG. 6 was repeated twice. Target concentration 0.25 was obtained in two ways: using one dilution step or two dilution steps. The actual concentration, as represented by absorbance data, was nearly identical in the two cases.

Figure 9:
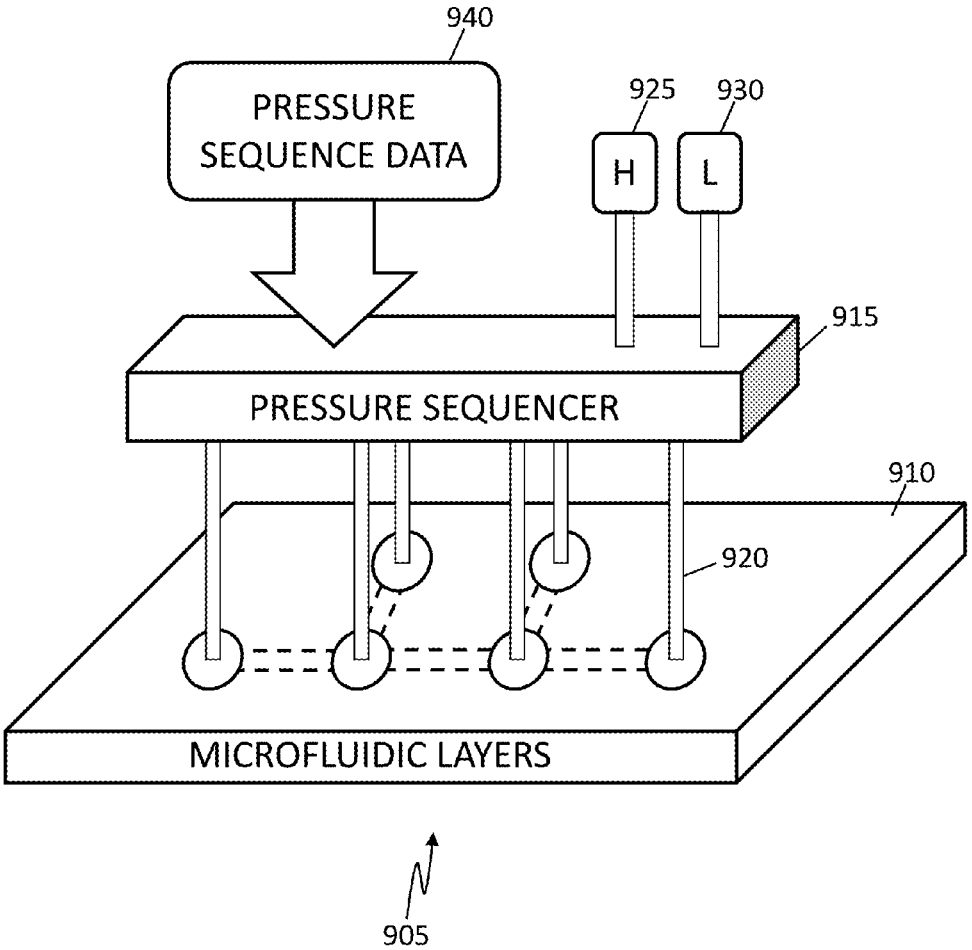
FIG. 9 is a diagram of a reconfigurable microfluidic system, including a pressure sequencer.

Examples 1 and 2 discussed above demonstrate that sequences of gas pressures, applied to reservoirs and nodes according to a fluid transfer rule, enable fluid to be moved from any reservoir to any other reservoir in a reconfigurable microfluidic system. FIG. 9 is a diagram of a reconfigurable microfluidic system 905, including a pressure sequencer 915.

In FIG. 9, microfluidic device 910 includes hydrophobic reservoirs, nodes and channels. These structures are formed in microfluidic layers of the device. Each reservoir and node is connected to pressure sequencer 915 via a gas tube, such as gas tube 920. Pressure sequencer 915 is connected to pressure sources 925 and 930. Pressure sequencer 915 includes a set of programmable gas valves.

The sequencer receives pressure sequence data 940. This data includes step by step instructions specifying what pressure is to be applied to each reservoir and node in device 910 in order to carry out a specific fluid transfer operation. As shown in Example 2, fluid can be moved from any reservoir to any other reservoir in a reconfigurable microfluidic system by repeating the steps of the fluid transfer rule.

In a laboratory experiment, pressure sequencer 915 was implemented as a set of electronically controlled pneumatic valves that were programmed using LabVIEW software (National Instruments Corporation) running on a personal computer. For the experiment, pressure sequence data necessary to move fluid from one reservoir to another in a reconfigurable microfluidic device was worked out manually. However a graphical software program may be written that allows a user to select origin and destination reservoirs, with the program then generating appropriate pressure sequence data by repeated application of the fluid transfer rule. In this way an intuitive system may be created that permits users to perform arbitrary microfluidic experiments without needing to understand the fluid transfer rule or other system operation details.

Reconfigurable microfluidic systems may have many reservoirs and nodes, especially those systems designed for parallel biochemical assays. One type of parallel assay involves performing many different biochemical experiments simultaneously on small volumes of fluid taken from one sample. A second type of parallel assay involves processing many different fluid samples simultaneously, in otherwise identical biochemical experiments. Both of these cases involve parallel operations in which groups of reservoirs or nodes change pressure together during the steps of a complex fluid transfer process.

Figure 10A:
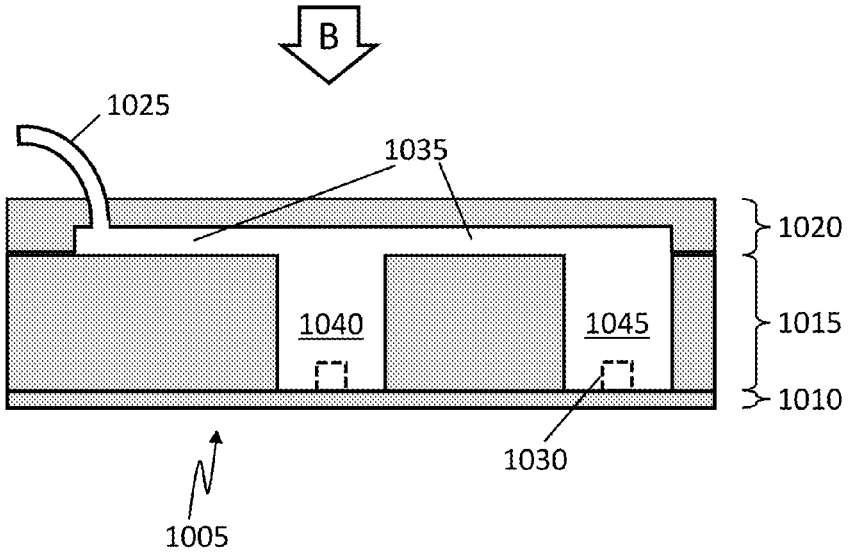
FIGS. 10A (cross sectional view) and 10B (plan view) are diagrams illustrating a gas flow manifold in a reconfigurable microfluidic device.

When a reconfigurable microfluidic device has reservoirs or nodes that are operated in a group, it is more convenient to integrate a gas flow manifold in the pneumatic layer of the device than to dedicate a separate gas tube to each reservoir or node. FIGS. 10A (cross sectional view) and 10B (plan view) are diagrams illustrating a gas flow manifold in a reconfigurable microfluidic device 1005.

Figure 10B:
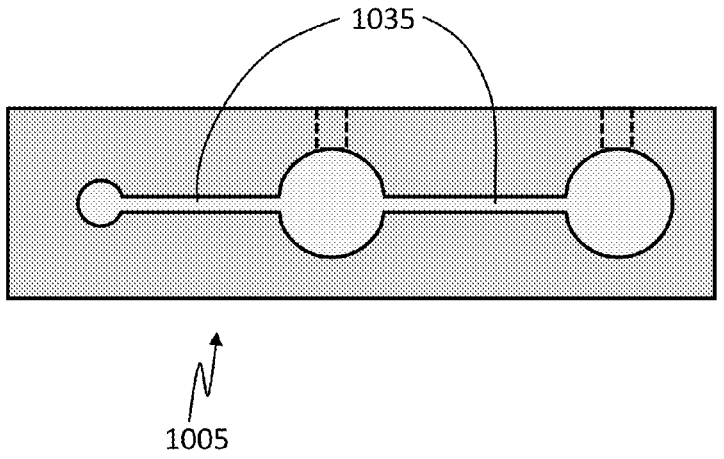

In FIG. 10A, the block arrow labeled 'B' indicates the perspective from which FIG. 10B is drawn. Device 1005 includes a substrate layer 1010, a hydrophobic microfluidic layer 1015, and a pneumatic layer 1020. Dashed lines, e.g. 1030, designate channels to microfluidic cavities that are not shown in FIG. 10A because they are not in the plane of the page. Gas tube 1025 is connected via gas flow manifold 1035 to cavity 1040 and cavity 1045. Any gas pressure supplied by the gas tube pressurizes both cavities at once. The layout of the gas flow manifold is shown in plan view in FIG. 10B. The gas flow manifold acts as a pressure port for groups of cavities that are operated in parallel.

One application for reconfigurable microfluidic devices such as those described above is microwell plate interfaces. Microwell plates (also known as microplates, multiwell plates, microtiter plates or Microtiter™ plates) are flat, plastic plates with small wells used as test tubes. Each well may hold tens of nanoliters to a few milliliters of fluid, depending on the size of the plate. Common microwell plates have 96, 384 or 1536 wells per plate. Microwell plates are ubiquitous in biochemical research and testing.

The devices shown in FIGS. 11-16 and 19 offer an interface between microfluidic systems and microwell plates. These reconfigurable microwell plate interfaces are similar to the reconfigurable microfluidic devices described above and operate on similar principles. The interfaces differ in two respects: first, they include input/output tubing that extends from the substrate layer of a microfluidic device into a microwell plate; second, they operate with four different applied pressure levels rather than just two. These four pressure levels are designated H1, H2, L and V, and they obey H1>H2>L>V. Furthermore, V is a pressure that is less than atmospheric pressure.

Two different "high" pressure levels H1 and H2 are necessary because the tubing that extends from a microwell plate interface into a microwell plate presents higher resistance to fluid flow than do channels of the device. Pressure H2 is used to move fluid between reservoirs and nodes, while higher pressure H1 is used to push fluid through hydrophobic tubing, into a microwell plate. Partial vacuum pressure, V, is necessary to draw fluid from a microwell plate or an external fluid source (at atmospheric pressure) into the interface.

Figure 11:
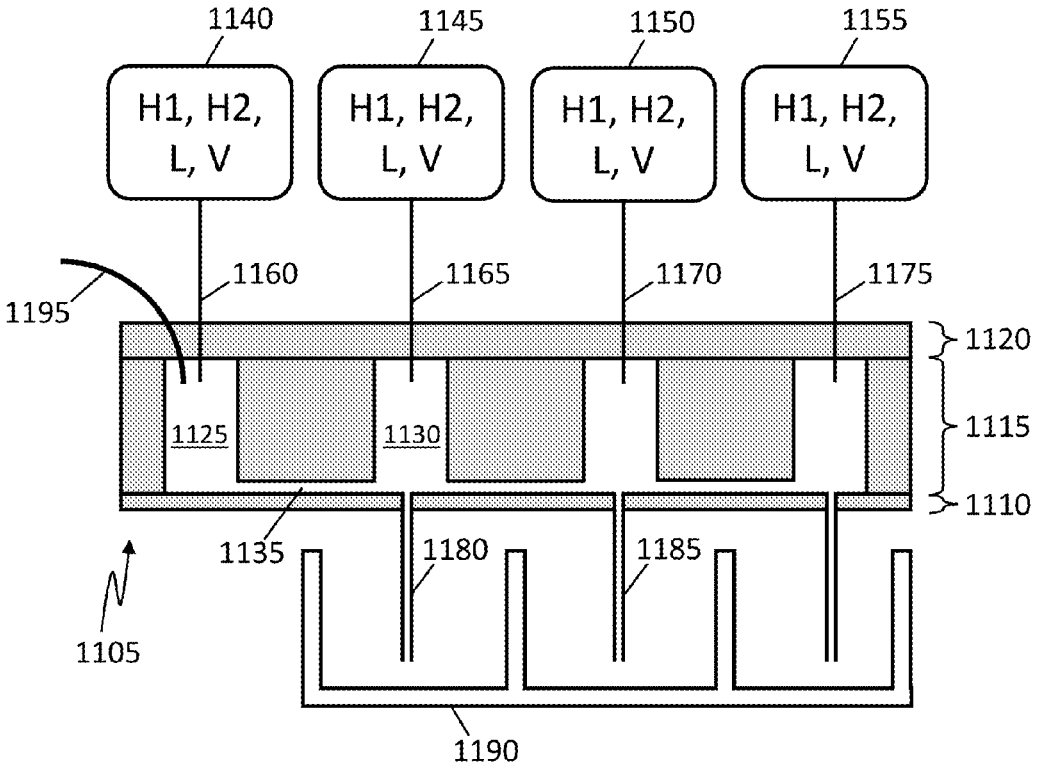
FIG. 11 is diagram of a reconfigurable microwell plate interface, seen in cross section.

FIG. 11 is diagram of a reconfigurable microwell plate interface, seen in cross section. The interface of FIG. 11 is similar to the device of FIG. 1 in many respects. In FIG. 11, interface 1105 includes a substrate layer 1110, hydrophobic fluidic layer 1115, and a pneumatic layer 1120. These layers may be fabricated using the techniques described above for reconfigurable microfluidic devices. Just as the device of FIG. 1, the interface of FIG. 11 includes reservoirs, such as reservoir 1125, and nodes, such as node 1130, that are connected by hydrophobic microfluidic channels, such as channel 1135. The definition of nodes and reservoirs remains the same and is based on whether a cavity is connected to only one or more than one channel.

In plan view (not shown) the device may be laid out such that the nodes and reservoirs are arranged in a line or in a rectangular grid to match a microwell plate. Each node or reservoir is spaced apart from its nearest neighbor by 9 mm (for an interface to a 96-well plate) or 4.5 mm (for an interface to a 384-well plate) or 2.25 mm (for an interface to a 1536-well plate). Each channel connects at most two cavities and each cavity is connected to at most four channels.

Pressure may be applied to each reservoir or node by a pressure source. In FIG. 11, pressure sources 1140, 1145, 1150 and 1155 apply pressure via gas tubes 1160, 1165, 1170 and 1175 respectively. Gas tube 1160 is connected to reservoir 1125 while gas tube 1165 is connected to node 1130. Tubing, e.g. input/output tubes 1180 and 1185, extends from reservoirs and nodes of the interface into wells of microwell plate 1190. Supply tube 1195 enables filling a reservoir from (or draining a reservoir to) an external fluid source. Supply tube 1195 is designed such that its flow resistance is significantly higher than that of channel 1135. This is accomplished by making the cross sectional area of the supply tube smaller than that of the channel, making the supply tube longer than the channel, or both.

A microwell interface device like 1105 is designed so that its reservoirs and nodes are spaced apart the same distance as microwells in a microwell plate. The interface does not necessarily need to have as many cavities equipped with tubing as the number of microwells in a microwell plate. An interface designed for a 96-well plate might only have 6 or 24 cavities with connected tubing, as examples. The interface may be positioned over different sections of the microwell plate as needed by a robot.

Figure 12:
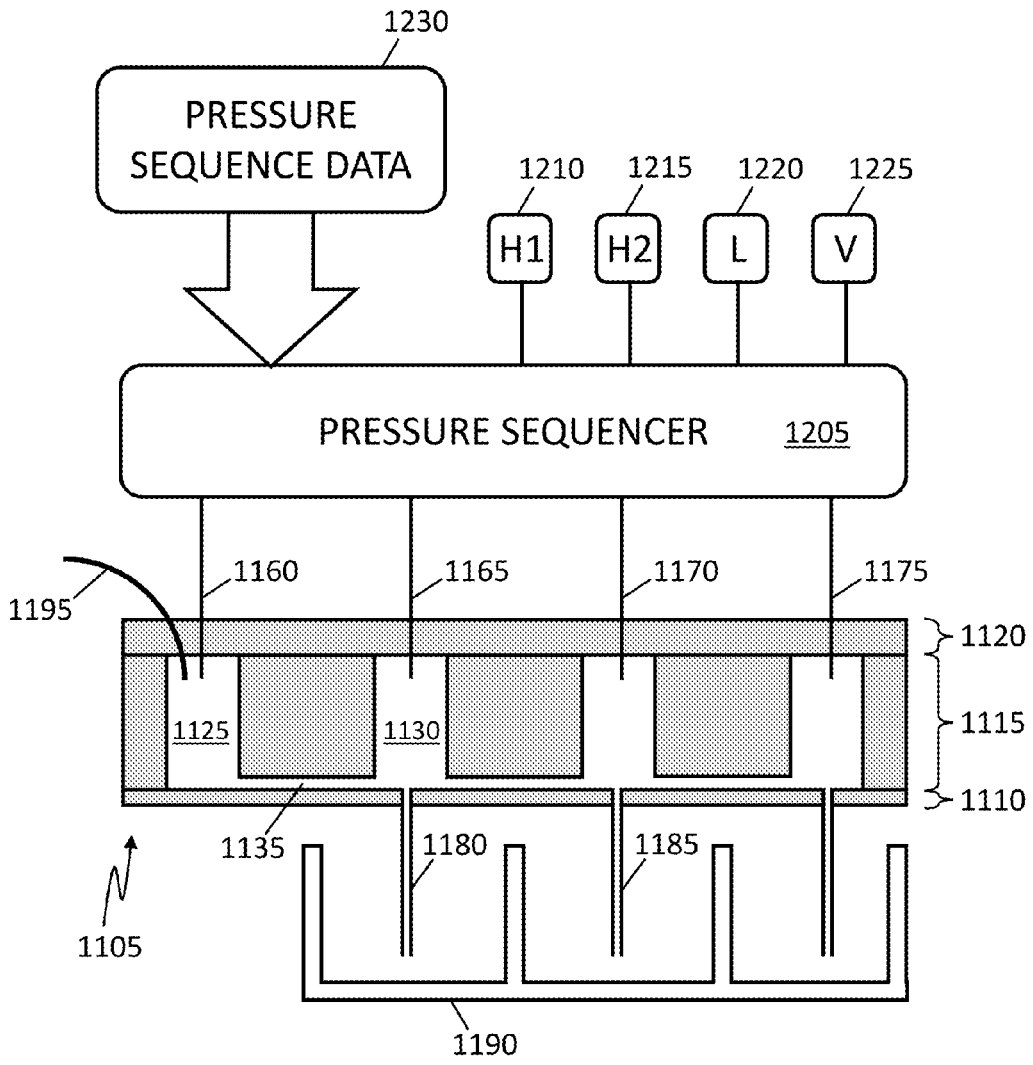
FIG. 12 is a diagram of a reconfigurable microwell plate interface, including a pressure sequencer.

FIG. 12 is a diagram of reconfigurable microwell plate interface, including a pressure sequencer. The interface of FIG. 12 is the same as that of FIG. 11 except that instead of pressure sources (1140-1155) for individual cavities a pressure sequencer 1205 distributes pressure from four sources (1210-1225) to each cavity. The sequencer includes a set of programmable gas valves and directs pressures to cavities in interface 1105 according to pressure sequence data 1230. Sequencer 1205 is similar to sequencer 915 discussed above except for the difference in the number of pressure sources. The two sequencers may be constructed from similar components. In FIGS. 13-16 and 19 pressures are shown as applied to cavities by individual pressure sources for ease of illustration; however, a pressures sequencer could be substituted in each case.

Figure 13:
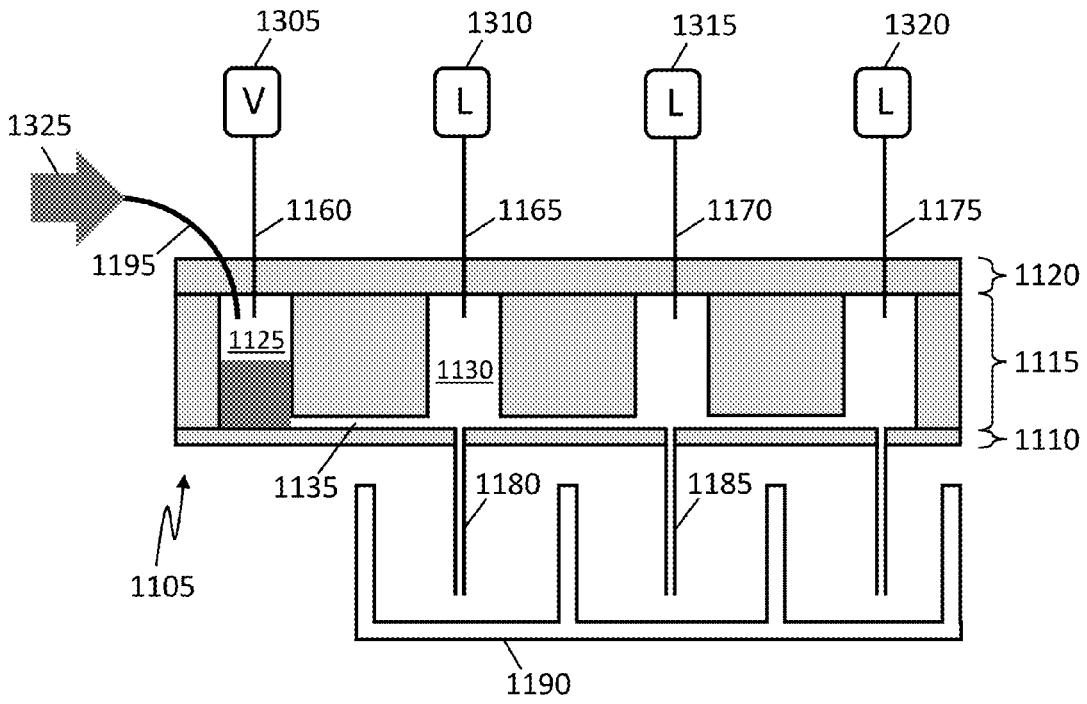
FIG. 13 is a diagram of a reconfigurable microwell plate interface, illustrating loading the interface from an external fluid source.
Figure 14:
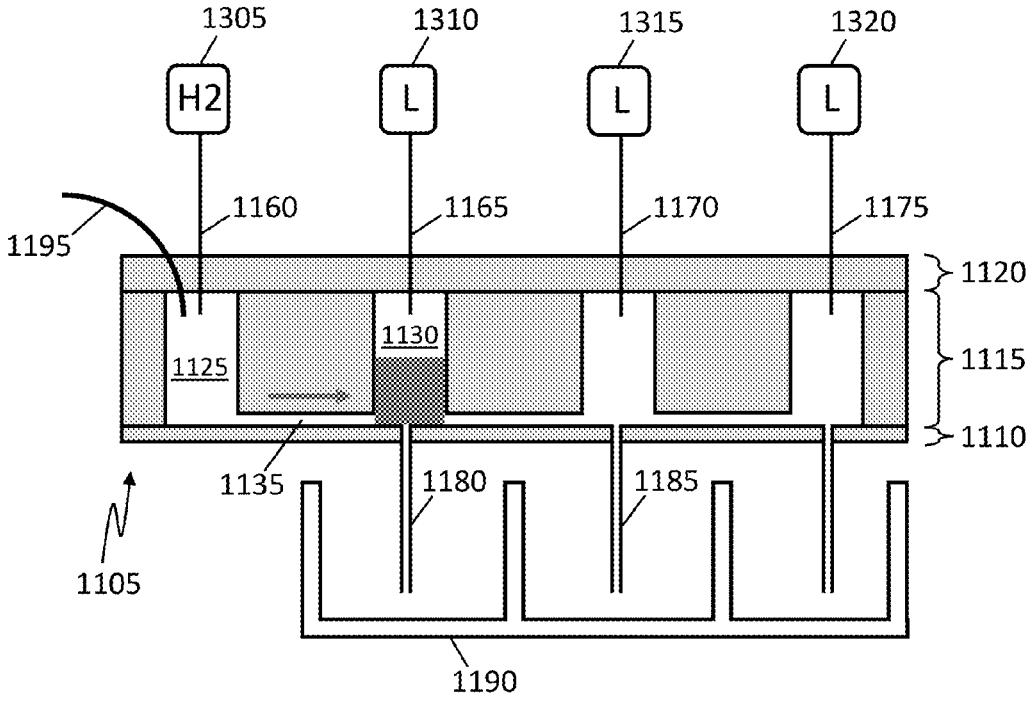
FIG. 14 is a diagram of a reconfigurable microwell plate interface, illustrating a fluid transfer operation.
Figure 15:
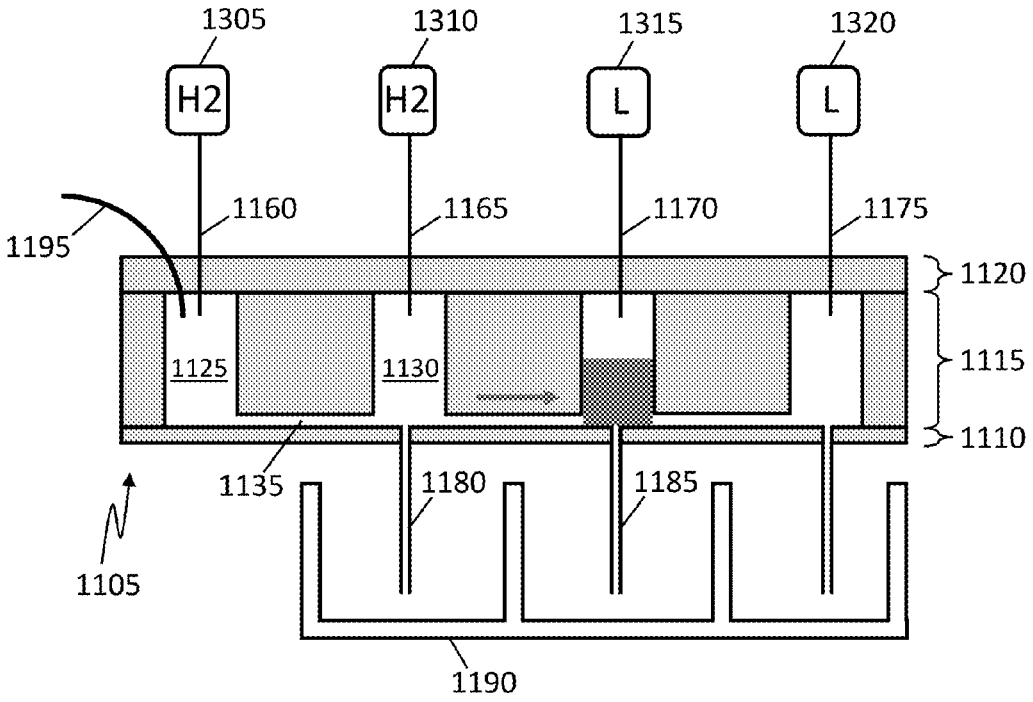
FIG. 15 is a diagram of a reconfigurable microwell plate interface, illustrating a fluid transfer operation.
Figure 16:
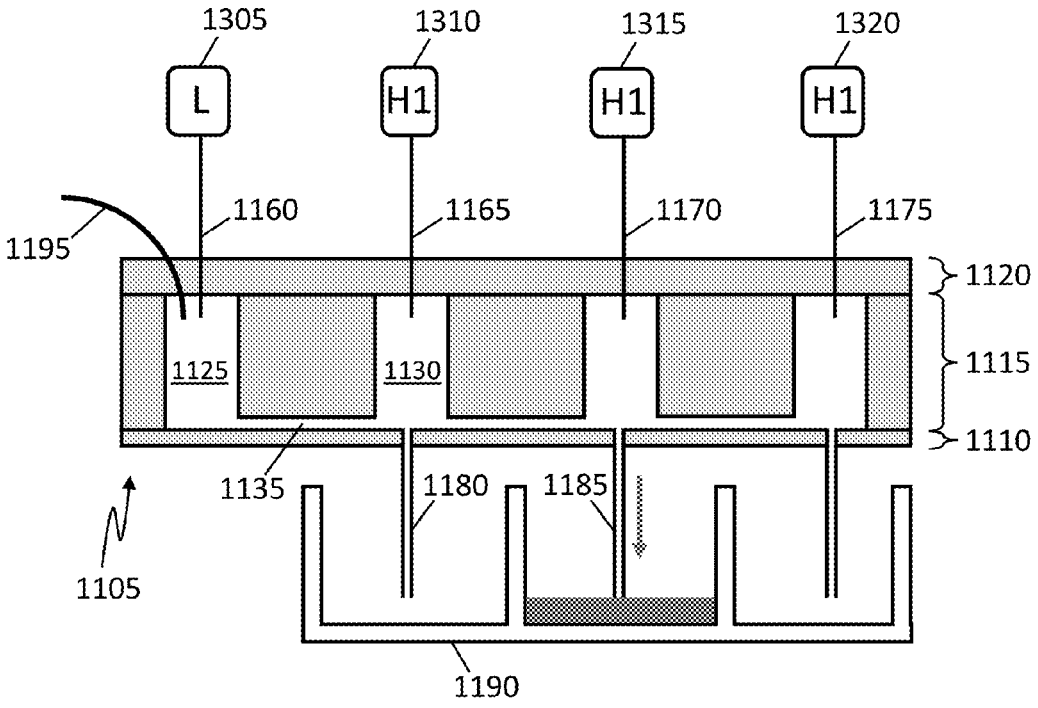
FIG. 16 is a diagram of a reconfigurable microwell plate interface, illustrating depositing fluid into a microwell plate.
Figure 19:
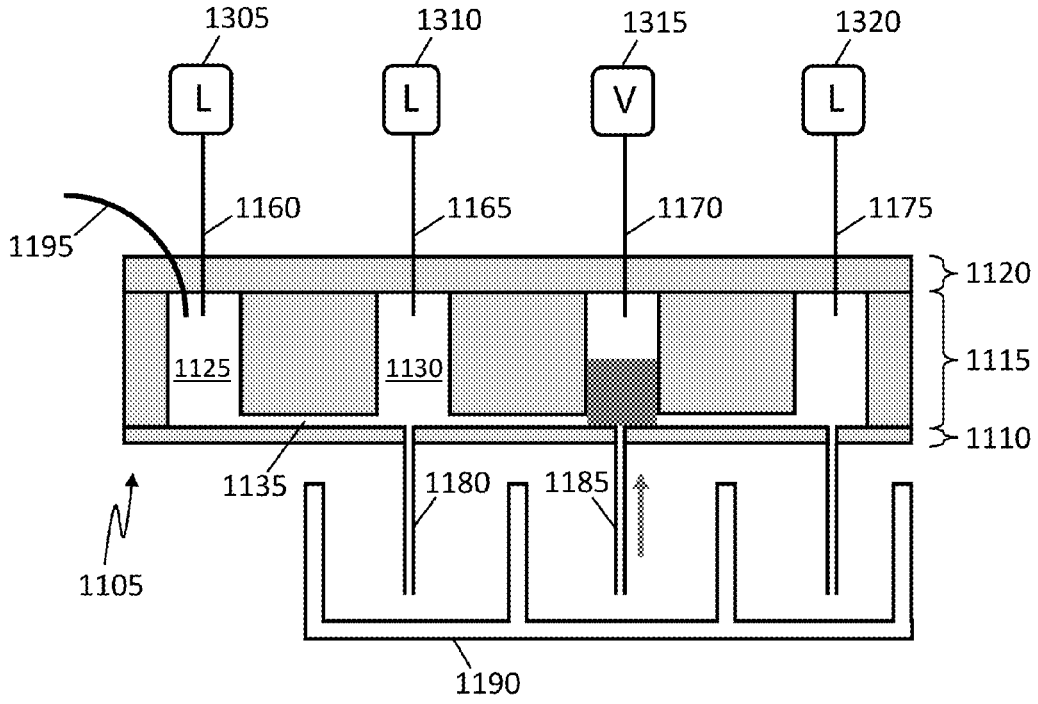
FIG. 19 is a diagram of a reconfigurable microwell plate interface, illustrating withdrawing fluid from a microwell plate.

FIGS. 13-16 and 19 illustrate different operations of the same microwell plate interface. FIG. 13 shows loading fluid from an external fluid source. FIGS. 14 and 15 show fluid transfer operations. FIG. 16 shows depositing fluid into a microwell plate. FIG. 19 shows withdrawing fluid from a microwell plate.

Figure 17:
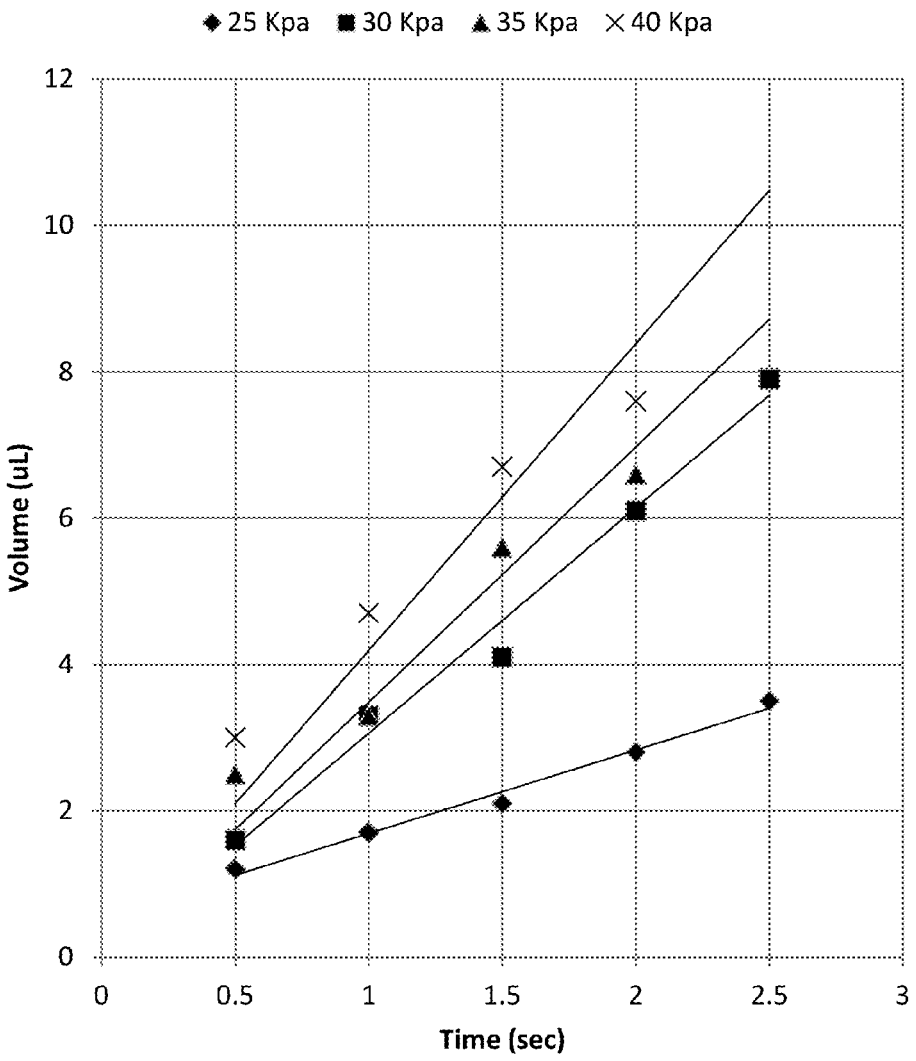
FIG. 17 is a graph of microwell plate interface performance for depositing fluid into a microwell plate.
Figure 18:
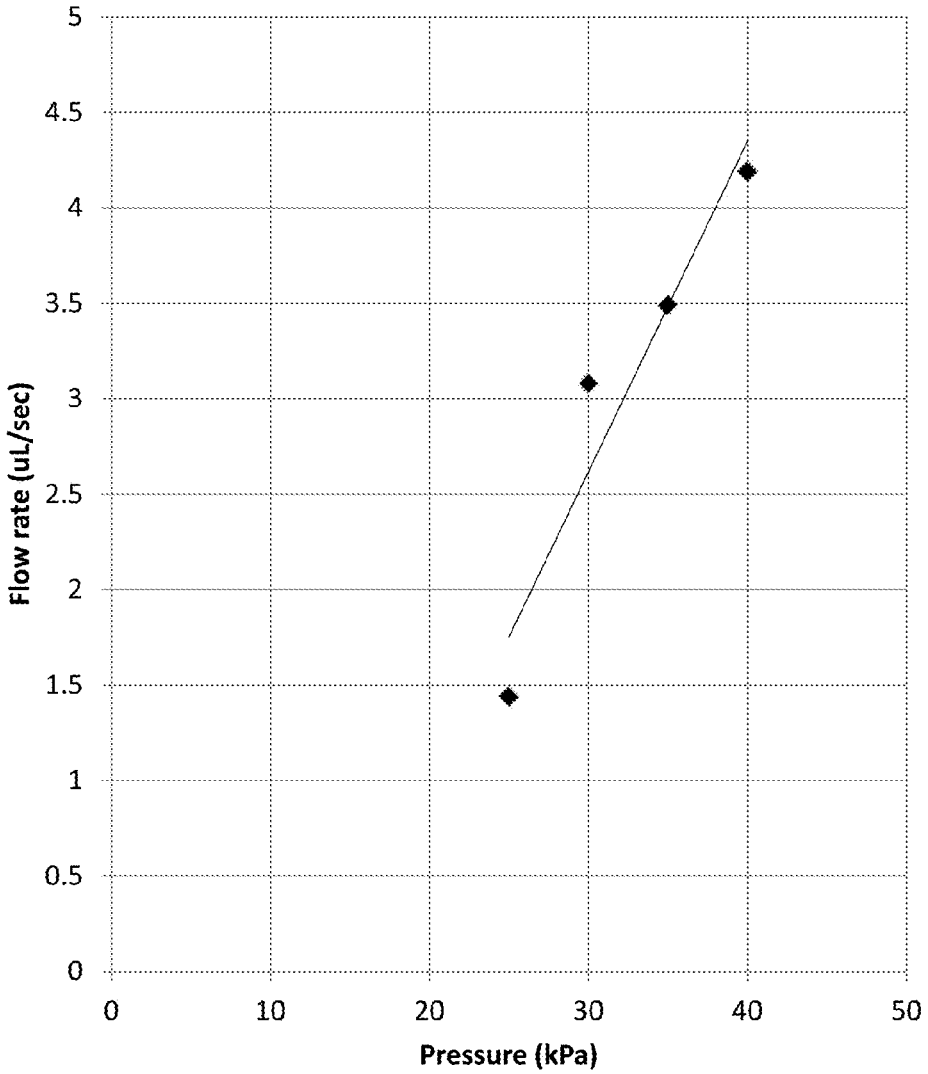
FIG. 18 is a graph of microwell plate interface performance for depositing fluid into a microwell plate.
Figure 20:
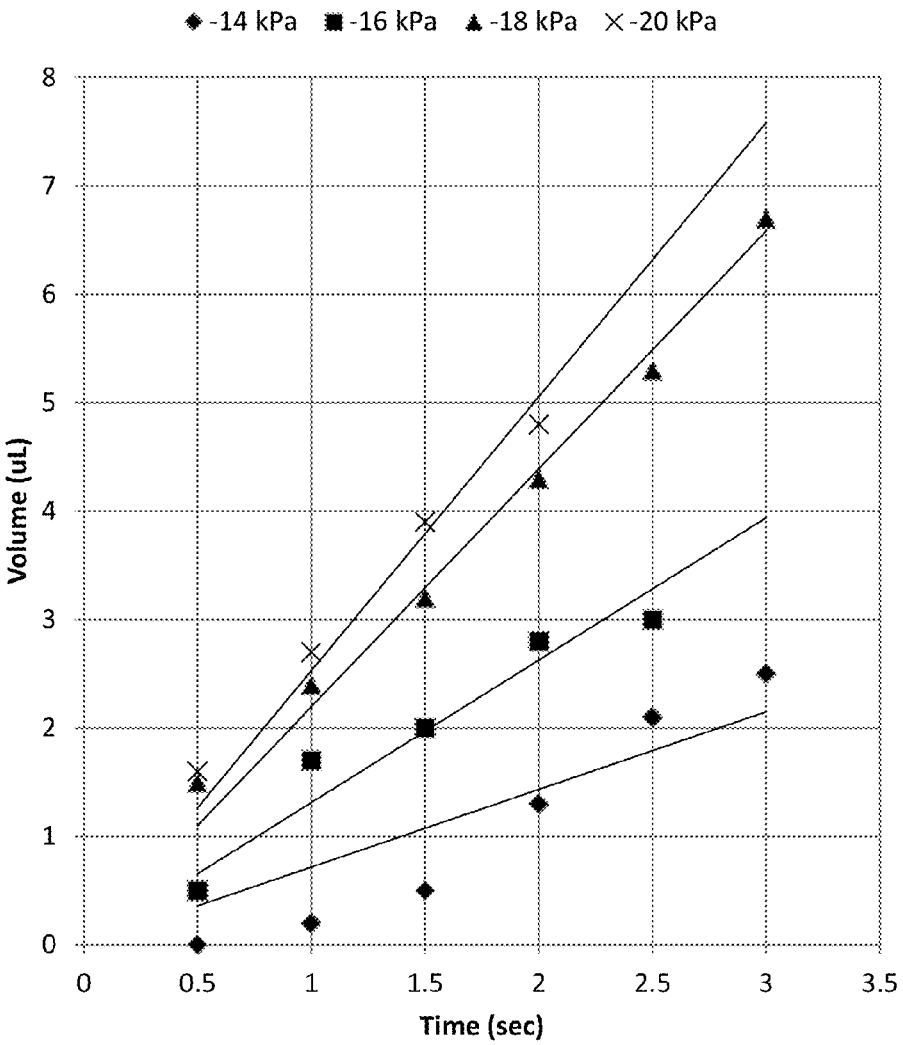
FIG. 20 is a graph of microwell plate interface performance for withdrawing fluid from a microwell plate.
Figure 21:
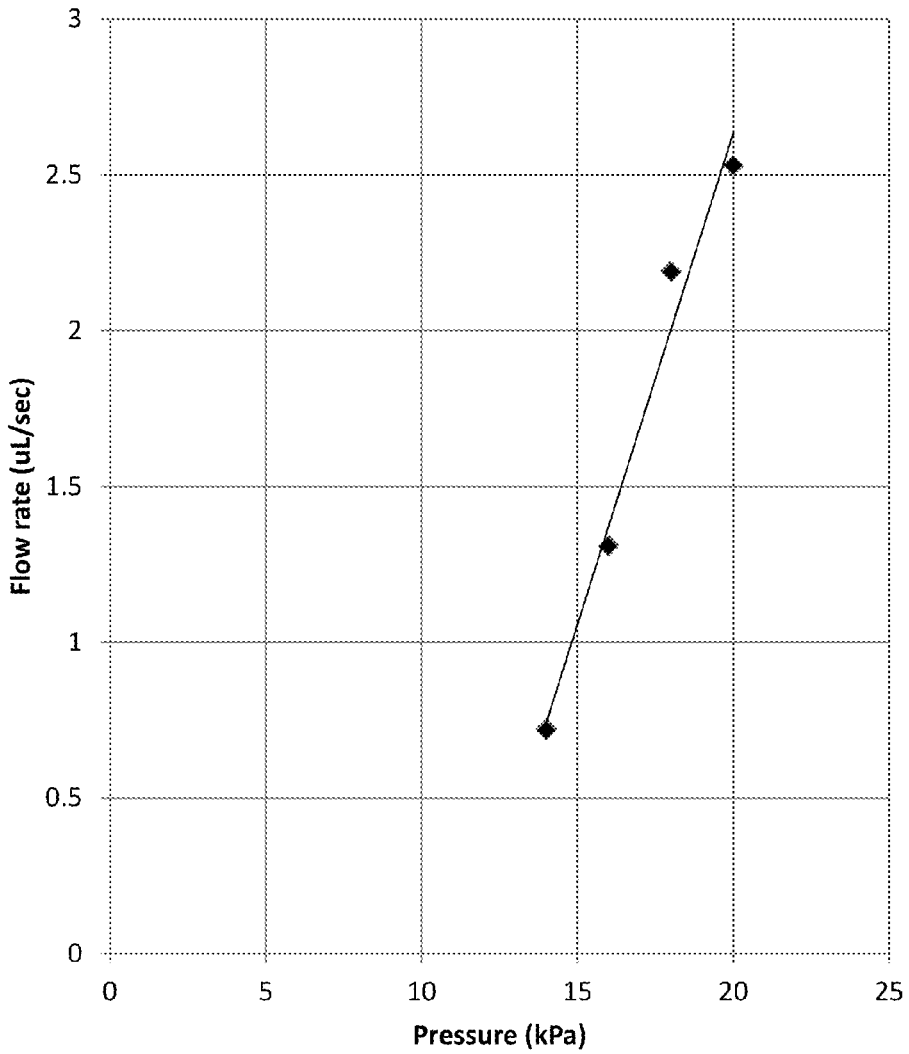
FIG. 21 is a graph of microwell plate interface performance for withdrawing fluid from a microwell plate.

FIGS. 17 and 18 are graphs of experimentally measured performance of a microwell plate interface while depositing fluid into a microwell plate. FIGS. 20 and 21 are graphs of experimentally measured performance of a microwell plate interface while withdrawing fluid from a microwell plate.

In FIG. 13, pressure sources 1305, 1310, 1315 and 1320 apply pressures V, L, L and L respectively. Partial vacuum V draws fluid from external fluid source 1325, through supply tube 1195, and into reservoir 1125. Fluid does not flow from reservoir 1125 to node 1130 via channel 1135 because the L pressure in the node is greater than the V pressure in the reservoir.

Once fluid has been accumulated in a reservoir, the fluid may be moved among the reservoirs and nodes of the interface according to the fluid transfer rule described above by using pressures H2 and L. Pressure H2 is sufficient to push fluid through channels (e.g. 1135) but not great enough to push fluid through tubing (e.g. 1180). Thus, the device may be operated with pressures H2 and L as if it didn't include any tubing leading to a microwell plate. FIGS. 14 and 15 provide examples of these kinds of operations.

FIGS. 14 and 15 show how fluid is moved from reservoir 1125 to node 1130 (FIG. 14) and then to a second node (FIG. 15). The fluid transfer rule described above specifies what pressures are needed for these operations where the "high" pressure is H2 and the "low" pressure is L.

FIG. 16 shows how fluid may be deposited into a microwell plate starting from the configuration of FIG. 15. In FIG. 16, pressure sources 1305, 1310, 1315 and 1320 apply pressures L, H1, H1 and H1 respectively. Fluid is pushed from the interface into the microwell plate via tube 1185. The fluid transfer rule that applies to this situation is the same as before. However, in this case, pressure H1 (>H2) is needed to push fluid through tube 1185. The pressure on the microwell plate is atmospheric pressure, rather than a controlled L pressure because the well plate is open to the atmosphere.

An experiment was conducted to measure the performance of a test system like that of FIG. 16 while depositing fluid from a node in the interface to a well in a microwell plate. In the test system, channels (e.g. channel 1135) measured 100 μm by 300 μm in cross section and were 4.35 mm long. Tubes (e.g. tube 1185) were made from polyetheretherketone (PEEK). They had an inside diameter of 100 μm and were 12.5 mm long. The experiment measured the volume of fluid that was pushed through tube 1185 for various applied pressures H1 and various time durations.

The results are presented in the graph of FIG. 17 which shows volume versus time data for four different pressures: 25, 30, 35 and 40 kPa above atmospheric pressure. Experimentally obtained data for each pressure is identified by various marker symbols shown in the legend at the top of the graph. Four lines through the data are linear fits, one for each pressure. FIG. 18 is a graph of the slopes of those lines; i.e. flow rate (μL/s) versus pressure (kPa). The line on the graph in FIG. 18 is a linear fit indicating how flow rate varies with pressure. At 35 kPa, the flow rate was 3.5 μL/s.

FIG. 19 shows how fluid may be withdrawn from a microwell plate starting from the configuration of FIG. 16. In FIG. 19, pressure sources 1305, 1310, 1315 and 1320 apply pressures L, L, V and L respectively. Fluid is sucked from the microwell plate into the interface via tube 1185. The fluid transfer rule that applies to this situation is the same as before. However, in this case, partial vacuum pressure V is needed to draw fluid through tube 1185. The pressure on the microwell plate is atmospheric pressure, rather than a controlled "high" pressure because the well plate is open to the atmosphere.

An experiment was conducted to measure the performance of a test system like that of FIG. 19 while withdrawing fluid from a well in a microwell plate. The test system was the same as that described in connection with FIGS. 16, 17 and 18. The experiment measured the volume of fluid that was sucked through tube 1185 for various applied pressures V and various time durations.

The results are presented in the graph of FIG. 20 which shows volume versus time data for four different pressures: −14, −16, −18 and −20 kPa. Here "−14 kPa" means 14 kPa lower than atmospheric pressure. Since atmospheric pressure is approximately 101 kPa, "−14 kPa" means that the absolute applied pressure V was about 87 kPa. Experimentally obtained data for each pressure is identified by various marker symbols shown in the legend at the top of the graph. Four lines through the data are linear fits, one for each pressure. FIG. 21 is a graph of the slopes of those lines; i.e. flow rate (μL/s) versus pressure magnitude (kPa). The line on the graph in FIG. 21 is a linear fit indicating how flow rate varies with pressure. At 20 kPa pressure magnitude, the flow rate was about 2.5 μL/s.

As demonstrated by the examples described above, a reconfigurable microfluidic system is capable of moving fluid from any reservoir to any other reservoir in the system. This capability is useful for a variety of microfluidic applications including an interface between microfluidic systems and microwell plates.

The above description of the disclosed embodiments is provided to enable any person skilled in the art to make or use the invention. Various modifications to these embodiments will be readily apparent to those skilled in the art, and the principles defined herein may be applied to other embodiments without departing from the scope of the disclosure. Thus, the disclosure is not intended to be limited to the embodiments shown herein but is to be accorded the widest scope consistent with the principles and novel features disclosed herein.

What is claimed is:

1. A reconfigurable microfluidic system comprising:

(a) a network of microfluidic cavities connected by hydrophobic microfluidic channels exhibiting, during operation, a hydrophobic threshold pressure, wherein:

reservoirs are cavities that are connected to only one channel each, and nodes are cavities that are connected to two or more channels each;

a plurality of the channels connect at most two cavities each;

a plurality of the cavities are connected to at most four channels each;

a plurality of the channels have a greater resistance to fluid flow than that of the nodes;

a plurality of the cavities include a gas pressure port; and at least one cavity has an input/output tube disposed above a well of the microwell plate, the input/output tube having a greater resistance to fluid flow than that of the microfluidic channels; and (b) a pressure sequencer including a set of gas valves, the pressure sequencer configured to connect, by gas tubing, to: a first high pressure gas source, a second high pressure gas source, a low pressure gas source, a partial vacuum pressure gas source, and to at least one cavity, wherein the first high gas pressure is greater than the second high gas pressure, the second high gas pressure is greater than the low gas pressure, the low gas pressure is greater than the partial vacuum pressure, and the partial vacuum pressure is less than atmospheric pressure, the pressure sequencer programmed to apply to at least one cavity, according to pressure sequence data following a fluid transfer rule in which:

the first high gas pressure is applied to a first origin cavity from which a fluid is expelled via its input/output tube and the first high gas pressure is also applied to any other cavity connected to the first origin cavity by a first channel;

the second high gas pressure is applied to a second origin cavity from which a fluid is transferred and the low gas pressure is applied to a first destination cavity to which the fluid is transferred, and the second high gas pressure is applied to any cavity (other than the first destination cavity) connected to the origin cavity by a second channel and the low gas pressure is applied to any cavity (other than the second origin cavity) connected to the first destination cavity by the second channel; and the partial vacuum gas pressure is applied to a second destination cavity to which a fluid is drawn via its input/output tube and low gas pressure is applied to any other cavity connected to the second destination cavity by a third channel.

2. The reconfigurable microfluidic system of claim 1, comprising a plurality of the cavities spaced apart from their nearest neighbors by 9 mm.

3. The reconfigurable microfluidic system of claim 1, comprising a plurality of the cavities spaced apart from their nearest neighbors by 4.5 mm.

4. The reconfigurable microfluidic system of claim 1, comprising a plurality of the cavities spaced apart from their nearest neighbors by 2.25 mm.

5. The reconfigurable microfluidic system of claim 1, comprising a plurality of the channels having a resistance to fluid flow at least 100 times greater than that of the nodes.

6. The reconfigurable microfluidic system of claim 1, comprising a plurality of the channels having a resistance to fluid flow at least 1,000 times greater than that of the nodes.

7. The reconfigurable microfluidic system of claim 1, comprising a plurality of the channels having a resistance to fluid flow at least 10,000 times greater than that of the nodes.

8. The reconfigurable microfluidic system of claim 1, the cavities being formed in a hydrophobic microfluidic layer that is bonded to a substrate layer, and the cavities being sealed by a pneumatic layer that is bonded to the microfluidic layer.

9. The reconfigurable microfluidic system of claim 8, the microfluidic layer being made from polydimethylsiloxane (PDMS).

10. The reconfigurable microfluidic system of claim 8, the microfluidic layer being made from fluorinated ethylene propylene (FEP).

11. The reconfigurable microfluidic system of claim 8, the microfluidic layer being made from polytetrafluoroethylene (PTFE).

12. The reconfigurable microfluidic system of claim 8, the pneumatic layer including a gas manifold that serves as a pressure port for two or more cavities.

13. The reconfigurable microfluidic system of claim 1 further comprising fluid tubing connecting a cavity to an external fluid store maintained at atmospheric pressure.

14. The reconfigurable microfluidic system of claim 1 further comprising gas tubing connecting one or more cavities to gas pressure sources via the gas pressure ports.

15. The reconfigurable microfluidic system of claim 1, at least one microfluidic channel having a gas pressure port.

16. The reconfigurable microfluidic system of claim 1, a plurality of the hydrophobic microfluidic channels presenting a hydrophobic pressure barrier to fluid flow that is less than the pressure difference between the second high gas pressure and the low gas pressure.

17. A method for arranging fluid in a microwell plate comprising operating the reconfigurable microfluidic system of claim 1 according to a set of pressure sequence data that causes the fluid to be drawn into the network from one well of the microwell plate and expelled into another well of the microwell plate.

18. The reconfigurable microfluidic system of claim 1, wherein the second high pressure is about 2 kPa and the low pressure is about 0 kPa.

19. The reconfigurable microfluidic system of claim 1, wherein the first high pressure is about 20 kPa, 25 kPa, 30 kPa, 35 kPa or 40 kPa above atmospheric pressure.

20. The reconfigurable microfluidic system of claim 1, wherein, during operation, the hydrophobic threshold pressure of hydrophobic microfluidic channels keeps fluid in nodes and reservoirs from leaking into the channels when no pressure differences are applied.

21. The reconfigurable microfluidic system of claim 20, wherein the hydrophobic threshold pressure of hydrophobic microfluidic channels is about 1 kPa.

22. The reconfigurable microfluidic system of claim 8, wherein the substrate layer is made of glass, polydimethylsiloxane (PDMS), polyethylene terephthalate (PET), or a hydrophobic thermoplastic polymer.

23. The reconfigurable microfluidic system of claim 22, wherein the hydrophobic thermoplastic polymer is a cyclic olefin copolymer (COC).

24. The reconfigurable microfluidic system of claim 1, wherein the microfluidic channels comprise cross-sectional dimensions in the range of about 100 μm to about 300 μm.

* * * * *